US008267203B2

(12) United States Patent
Oxford

(10) Patent No.: US 8,267,203 B2
(45) Date of Patent: Sep. 18, 2012

(54) EARTH-BORING TOOLS AND COMPONENTS THEREOF INCLUDING EROSION-RESISTANT EXTENSIONS, AND METHODS OF FORMING SUCH TOOLS AND COMPONENTS

(75) Inventor: James Andy Oxford, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 376 days.

(21) Appl. No.: 12/537,849

(22) Filed: Aug. 7, 2009

(65) Prior Publication Data

US 2011/0031026 A1 Feb. 10, 2011

(51) Int. Cl.
*E21B 17/18* (2006.01)

(52) U.S. Cl. ..... 175/320; 175/425

(58) Field of Classification Search ..... 175/425, 175/435, 393, 320; 76/108.2, 108.4
See application file for complete search history.

(56) References Cited

U.S. PATENT DOCUMENTS

| | | | | |
|---|---|---|---|---|
| 1,860,214 | A * | 5/1932 | Yeaman | 175/107 |
| 1,919,553 | A * | 7/1933 | Hawthorne | 175/393 |
| 2,966,949 | A * | 1/1961 | Wepsala, Jr. | 175/379 |
| 3,112,803 | A * | 12/1963 | Rowley | 175/393 |
| 3,922,038 | A | 11/1975 | Scales | |
| 3,945,446 | A | 3/1976 | Ostertag et al. | |
| 4,542,798 | A | 9/1985 | Madigan | |
| 4,884,477 | A * | 12/1989 | Smith et al. | 76/108.2 |
| 5,508,334 | A | 4/1996 | Chen | |
| 5,829,539 | A | 11/1998 | Newton et al. | |
| 5,927,410 | A | 7/1999 | Greer et al. | |
| 6,142,248 | A | 11/2000 | Thigpen et al. | |
| 2004/0245024 | A1 | 12/2004 | Kembaiyan | |
| 2006/0266557 | A1 | 11/2006 | Estes | |
| 2007/0102199 | A1 | 5/2007 | Smith et al. | |
| 2007/0102200 | A1 | 5/2007 | Choe et al. | |
| 2007/0102202 | A1 | 5/2007 | Choe et al. | |
| 2007/0256862 | A1 | 11/2007 | Lund et al. | |
| 2008/0135304 | A1 | 6/2008 | Duggan et al. | |
| 2008/0202820 | A1 | 8/2008 | Eason et al. | |
| 2008/0236899 | A1 | 10/2008 | Oxford et al. | |
| 2009/0020334 | A1 | 1/2009 | Gavia | |
| 2009/0152013 | A1 | 6/2009 | Buske et al. | |

OTHER PUBLICATIONS

U.S. Appl. No. 12/398,066, filed Mar. 4, 2009, entitled "Methods of Forming Erosion Resistant Composites, Methods of Using the Same, and Earth-Boring Tools Utilizing the Same in Internal Passageways," by Jimmy W. Eason et al.

U.S. Appl. No. 12/429,059, filed Apr. 23, 2009, entitled "Earth-Boring Tools and Components Thereof Including Methods of Attaching At Least One of a Shank and a Nozzle to a Body of an Earth-Boring Tool and Tools and Components Formed by Such Methods," by Oliver Matthews III et al.

International Search Report for International Application No. PCT/US2010/044448 mailed Mar. 23, 2011, 3 pages.

International Written Opinion for International Application No. PCT/US2010/044448 mailed Mar. 23, 2011, 3 pages.

International Preliminary Report on Patentability for International Application No. PCT/US2010/044448 dated Feb. 7, 2012, 5 pages.

* cited by examiner

*Primary Examiner* — Kenneth L Thompson
(74) *Attorney, Agent, or Firm* — TraskBritt

(57) ABSTRACT

Earth-boring drill bits include a bit body, an erosion-resistant extension, and a shank. The erosion-resistant extension includes a generally tubular body, and an erosion-resistant material lining the generally tubular body within a fluid passageway. The erosion-resistant material lining the generally tubular body within the fluid passageway exhibits an erosion resistance greater than an erosion resistance exhibited by a material of the generally tubular body. Methods of forming an erosion-resistant extension include lining at least a portion of a wall of a generally tubular body within a fluid passageway extending through the generally tubular body with an erosion-resistant material.

22 Claims, 3 Drawing Sheets

EARTH-BORING TOOLS AND COMPONENTS THEREOF INCLUDING EROSION-RESISTANT EXTENSIONS, AND METHODS OF FORMING SUCH TOOLS AND COMPONENTS

TECHNICAL FIELD

The present invention relates generally to earth-boring drill bits and other tools that may be used to drill subterranean formations and to methods of manufacturing such drill bits and tools.

BACKGROUND

Rotary drill bits are commonly used for drilling wellbores in earth formations. One type of rotary drill bit is the fixed-cutter bit (often referred to as a "drag" bit), which conventionally includes a plurality of cutting elements secured to a face region of a bit body. The bit body of a rotary drill bit may be formed from steel. Alternatively, a bit body may be fabricated to comprise a composite material. A so-called "infiltration" bit includes a bit body comprising a particle-matrix composite material and is fabricated in a mold using an infiltration process. Recently, pressing and sintering processes have been used to form bit bodies of drill bits and other tools comprising particle-matrix composite materials. Such pressed and sintered bit bodies may be fabricated by pressing (e.g., compacting) and sintering a powder mixture that includes hard particles (e.g., tungsten carbide) and particles of a metal matrix material (e.g., a cobalt-based alloy, an iron-based alloy, or a nickel-based alloy). Typically, a metal blank, comprising a metal alloy, such as a steel alloy, is positioned at least partially within the bit body during formation to facilitate attachment of the bit body to a steel shank.

New particle-matrix composite materials are currently being investigated in an effort to improve the performance and durability of earth-boring rotary drill bits. Examples of such new particle-matrix composite materials are disclosed in, for example, now U.S. patent application Ser. No. 11/272,439, filed Nov. 10, 2005, now U.S. Pat. No. 7,776,256, issued Aug. 17. 2010, U.S. patent application Ser. No. 11/540,912, filed Sep. 29, 2006, now U.S. Pat. No. 7,913,779, issued Mar. 29, 2011. and U.S. patent application Ser. No. 11/593,437, filed Nov. 6, 2006, now U.S. Pat. No. 7,784,567, issued Aug. 31, 2010. the disclosure of each of which is incorporated herein in its entirety by this reference.

Such new particle-matrix composite materials may include matrix materials that have a melting point relatively higher than the melting point of conventional matrix materials used in infiltration processes. By way of example and not limitation, nickel-based alloys, cobalt-based alloys, cobalt and nickel-based alloys, aluminum-based alloys, and titanium-based alloys are being considered for use as matrix materials in new particle-matrix composite materials. Such new matrix materials may have a melting point that is proximate to or higher than the melting points of metal alloys (e.g., steel alloys) conventionally used to form a metal blank, and/or they may be chemically incompatible with such metal alloys conventionally used to form a metal blank. Accordingly, bit bodies that comprise such new particle-matrix composite materials may require melting and/or sintering at temperatures proximate to or higher than the melting points of metal alloys (e.g., steel alloys) conventionally used to form a metal blank.

One alternative to the use of a metal blank is an extension (which is also referred to in the art as a "crossover"). One example of an extension is disclosed in U.S. patent application Ser. No. 12/429,059, filed Apr. 23, 2009 and entitled "Earth-Boring Tools and Components Thereof Including Methods of Attaching at Least One of a Shank and a Nozzle to a Body of an Earth-Boring Tool and Tools and Components Formed by Such Methods," the disclosure of which is incorporated herein in its entirety by this reference. Such extensions provide a means for attaching a bit body to a steel shank after the bit body has been fully formed. The extension conventionally comprises a metal alloy (e.g., steel alloy) and may be coupled to the bit body via, for example, metal brazing or a threaded connection.

During drilling and as is conventional, solids-laden drilling fluid, or "mud," is pumped down the wellbore through an internal fluid plenum extending through the drill bit to cool and clean the cutting elements on the bit face and to flush debris removed by the drill bit from the subterranean formation being drilled from the bit face and up the wellbore annulus. The drilling fluid passes through a fluid passageway extending, in part, through the extension. As the drilling fluid is caused to flow through the extension, the drilling fluid may erode the interior surfaces of the extension. This erosion can weaken the extension itself and the connections between the extension, the steel shank and the crown. Consequently, this erosion can cause failure of the drill bit, which, in turn, results in time and money expended to replace or repair the drill bit.

BRIEF SUMMARY OF THE INVENTION

In some embodiments, the present invention includes erosion-resistant extensions for earth-boring rotary drill bits. The erosion-resistant extensions include a generally tubular body having a fluid passageway therethrough and a lining of an erosion-resistant material within at least a portion of the fluid passageway. The generally tubular body has an outer surface, an inner surface, a first end configured for attachment to a bit body of an earth-boring rotary drill bit, and an opposite, second end configured for attachment to a shank. The erosion-resistant material of the lining exhibits an erosion resistance greater than an erosion resistance exhibited by a material of the generally tubular body.

In additional embodiments, the present invention includes earth-boring rotary drill bits that include a bit body, at least one cutting element on the bit body, and an extension coupling the bit body to a shank. The extension includes a generally tubular body having a shape defining a fluid passageway extending through the generally tubular body. The generally tubular body includes an inner surface and an outer surface that extend between a first end and an opposite, second end of the generally tubular body. An erosion-resistant material lines at least a portion of the generally tubular body within the fluid passageway. The erosion-resistant material of the lining exhibits an erosion resistance greater than an erosion resistance exhibited by a material of the generally tubular body. The first end of the generally tubular body is coupled to the bit body, and the shank is coupled to the opposite, second end of the generally tubular body. The shank is configured for attachment to a drill string.

In yet additional embodiments, the present invention includes methods of forming earth-boring rotary drill bits in which at least a portion of a wall of a generally tubular body within a fluid passageway extending through the generally tubular body is lined with an erosion-resistant material. The erosion-resistant material is selected to exhibit an erosion resistance greater than an erosion resistance exhibited by a material of the generally tubular body. A first end of the generally tubular body of the extension is coupled to an earth-boring rotary drill bit, and a shank is coupled to an opposite, second end of the generally tubular body of the extension.

BRIEF DESCRIPTION OF THE SEVERAL VIEWS OF THE DRAWINGS

While the specification concludes with claims particularly pointing out and distinctly claiming that which is regarded as the present invention, the advantages of embodiments of the present invention may be more readily ascertained from the following description of embodiments of the invention when read in conjunction with the accompanying drawings in which:

DETAILED DESCRIPTION OF THE INVENTION

The illustrations presented herein are not meant to be actual views of any particular drill bit or component of a drill bit, but are merely idealized representations used to describe embodiments of the present invention. Additionally, elements common between figures may retain the same numerical designation.

Figure 1:
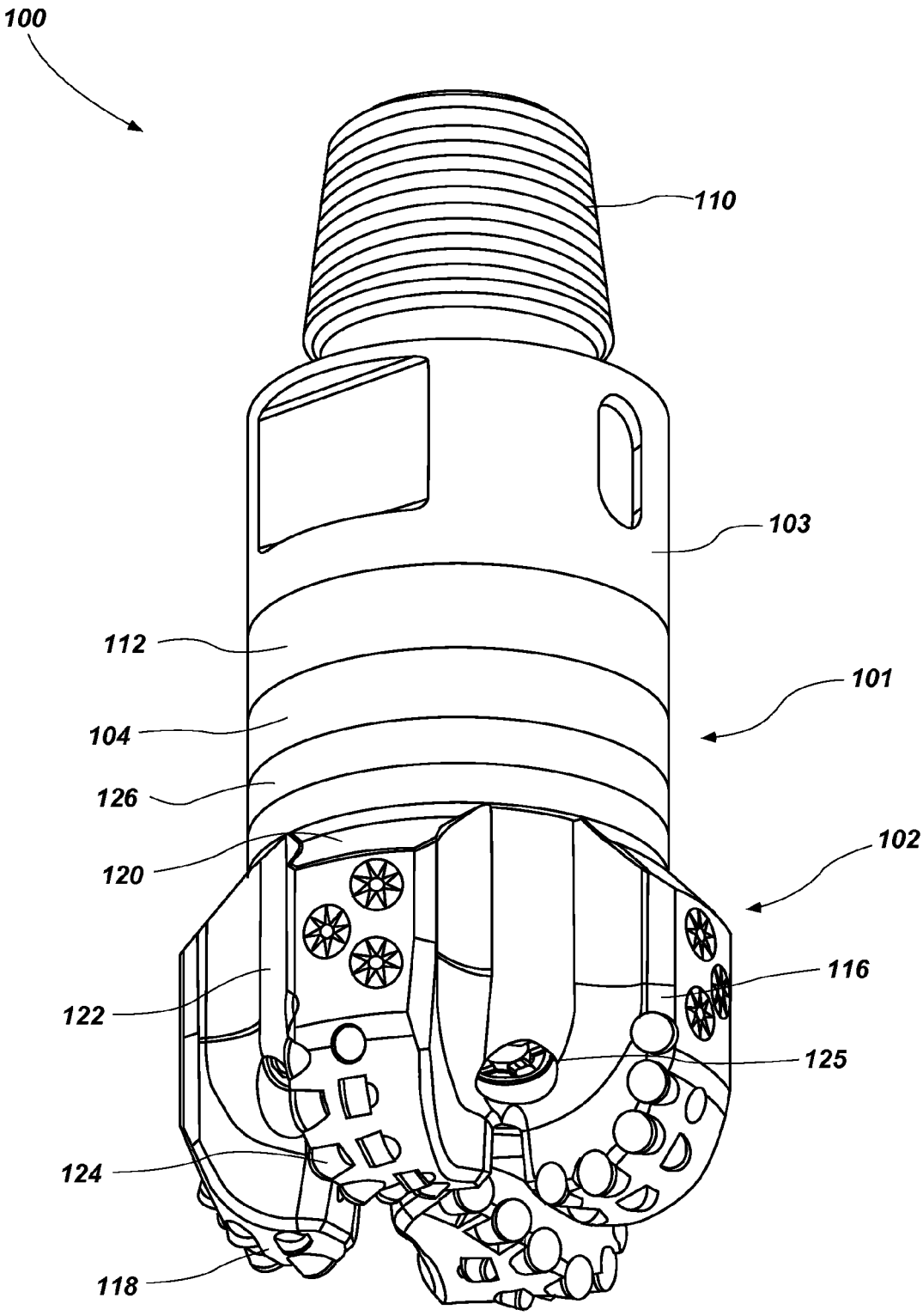
FIG. 1 is a perspective view of an embodiment of an earth-boring rotary drill bit of the present invention that includes an erosion-resistant extension coupling a bit body of the drill bit to a shank of the drill bit.
Figure 2:
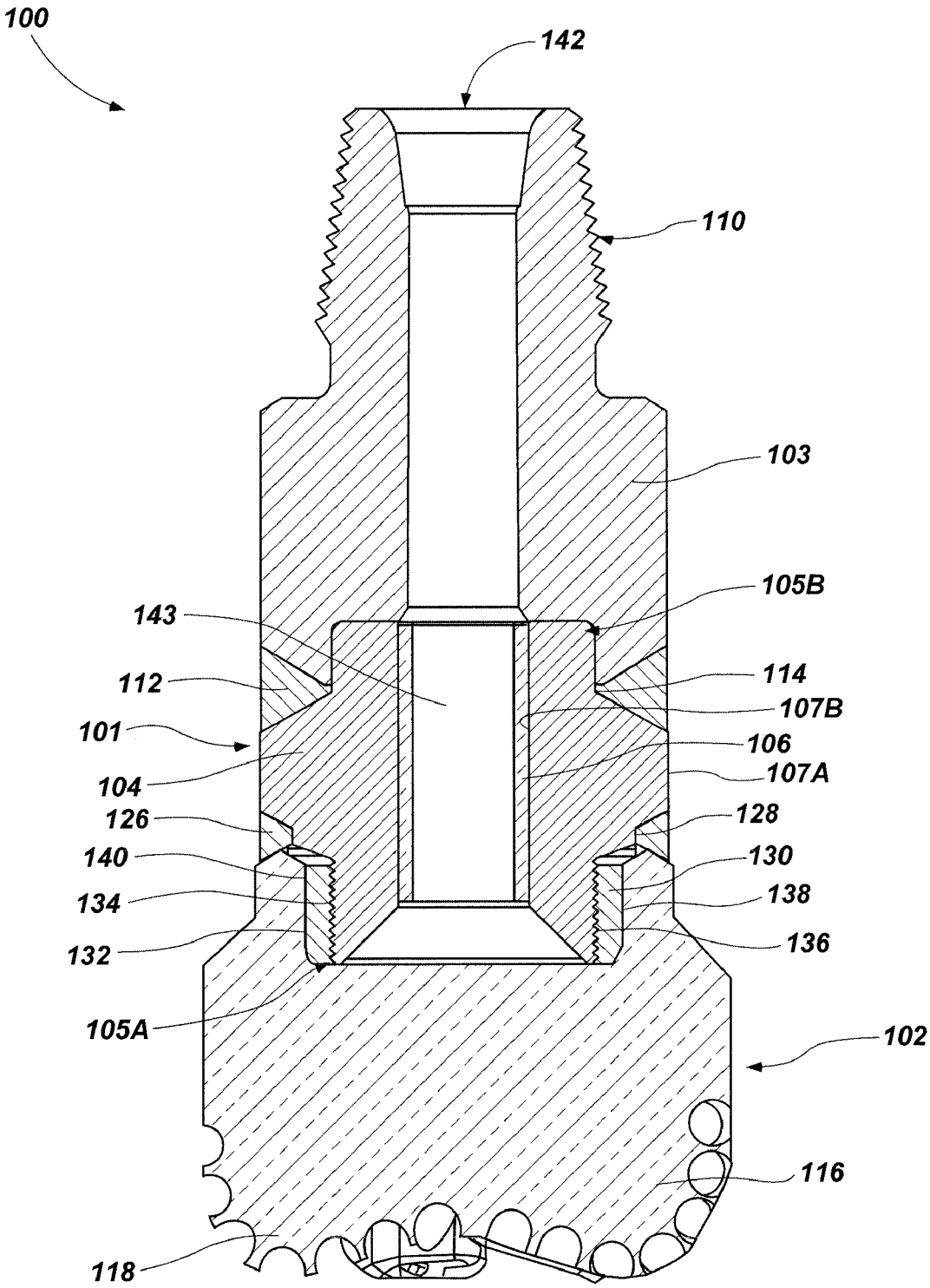
FIG. 2 is a longitudinal cross-sectional view of the earth-boring rotary drill bit shown in FIG. 1.

An embodiment of an earth-boring rotary drill bit 100 of the present invention is shown in FIGS. 1 and 2. The drill bit 100 includes a bit body 102, an erosion-resistant extension 101, and a shank 103. As shown in FIG. 2, the erosion-resistant extension 101 includes a generally tubular body 104 and an erosion-resistant material 106 that lines at least a portion of the body 104 within an internal fluid passageway 143 extending through the generally tubular body 104, as discussed in further detail below.

The shank 103 is configured for attachment to a drill string (not shown). In other words, the shank 103 is used to couple the bit body 102 (and the extension 101) to a drill string. The shank 103 may include a threaded connection portion 110 for attaching the drill bit 100 to a drill string. The threaded connection portion 110 may comprise, for example, a threaded pin that conforms to industry standards for drill string connections, such as, for example, those promulgated by the American Petroleum Institute (API). By way of example and not limitation, the shank 103 may be at least substantially comprised of, for example, steel, another iron-based alloy, or any other metal alloy or material that exhibits acceptable physical properties (e.g., strength, toughness, hardness, etc.).

The bit body 102, in some embodiments, may comprise a particle-matrix composite material 116, such as those previously discussed and described in U.S. patent application Ser. No. 11/272,439, filed Nov. 10, 2005, now U.S. Pat. No. 7,776,256, issued Aug. 17, 2010, U.S. patent application Ser. No. 11/540,912, filed Sep. 29, 2006, now U.S. Pat. No. 7,913,779, issued Mar. 29, 2011, and U.S. patent application Ser. No. 11/593,437, filed Nov. 6, 2006, now U.S. Pat. No. 7,784,567 issued Aug. 31, 2010, the disclosure of each of which is incorporated herein in its entirety by this reference. In some embodiments, the bit body 102 may be formed using pressing and sintering processes like those disclosed in the aforementioned patent applications. The particle-matrix composite material 116 may comprise a plurality of hard particles dispersed throughout a matrix material. In some embodiments, the hard particles may comprise a material selected from diamond, boron carbide, boron nitride, silicon nitride, aluminum nitride, and carbides or borides of the group consisting of W, Ti, Mo, Nb, V, Hf, Zr, Si, Ta, and Cr. The matrix material may be selected from the group consisting of iron-based alloys, nickel-based alloys, cobalt-based alloys, titanium-based alloys, aluminum-based alloys, iron and nickel-based alloys, iron and cobalt-based alloys, and nickel and cobalt-based alloys. As used herein, the term "[metal]-based alloy" (where [metal] is any metal) means commercially pure [metal] in addition to metal alloys wherein the weight percentage of [metal] in the alloy is greater than or equal to the weight percentage of all other components of the alloy individually.

As shown in FIG. 1, in some embodiments, the bit body 102 may include a plurality of blades 120 separated by fluid courses 122. A plurality of cutting elements 124, such as, for example, PDC (polycrystalline diamond compact) cutting elements, may be mounted on a face 118 of the bit body 102 along each of the blades 120. Nozzles 125 also may be provided at the face 118 of the bit body 102 for controlling the flow rate, velocity, and direction of drilling fluid flowing out from the drill bit 100.

As previously mentioned, the extension 101 includes generally tubular body 104 having a shape defining a fluid passageway 143 extending through the generally tubular body 104 between a first end 105A of the generally tubular body 104 and an opposite, second end 105B of the generally tubular body 104. The generally tubular body 104 has an outer surface 107A and an inner surface 107B that extend between the first end 105A and the second end 105B of the generally tubular body 104. The inner surface 107B of the generally tubular body 104 is exposed within the fluid passageway 143.

The bit body 102 may be at least partially secured to the first end 105A of the generally tubular body 104 by a weld 126 extending at least partially around the drill bit 100 on an exterior surface thereof along an interface between the generally tubular body 104 and the bit body 102 in a concentric channel 128 (i.e., a weld groove). In some embodiments, as shown in FIG. 2 and described in the aforementioned U.S. patent application Ser. No. 12/429,059, the disclosure of which has been incorporated herein by reference, a threaded element 130 may be disposed within a cavity 132 formed in the bit body 102, and the threaded element 130 also may be used to secure the bit body 102 to the first end 105A of the generally tubular body 104. The threaded element 130 may include a threaded portion 134, which may be engaged to a threaded element 136 formed on the generally tubular body 104. The threaded element 136 may be secured to a planar surface 138 of the cavity 132 using a bonding material 140, such as, for example, an adhesive or a metal-alloy braze material.

The shank 103 may be at least partially secured to the second end 105B of the generally tubular body 104 by a weld 112 extending at least partially around the drill bit 100 on an exterior surface thereof along an interface between the shank 103 and the generally tubular body 104 in a channel 114 (e.g., a weld groove).

The drill bit 100, as shown in FIGS. 1 and 2, has an internal fluid plenum 142 that extends through the shank 103, the extension 101, and bit body 102. The fluid passageway 143 that extends through the generally tubular body 104 forms part of (i.e., a section of) the fluid plenum 142. Additional fluid passageways, which are not shown in FIG. 2, extend through the bit body 102 from the internal fluid plenum 142 to nozzles 125 (FIG. 1). During drilling, drilling fluid may be pumped down the center of the drill string, through the internal fluid plenum 142 (and the fluid passageway 143 in the extension 101) and fluid passageways, and out the nozzles 125.

Figure 3:
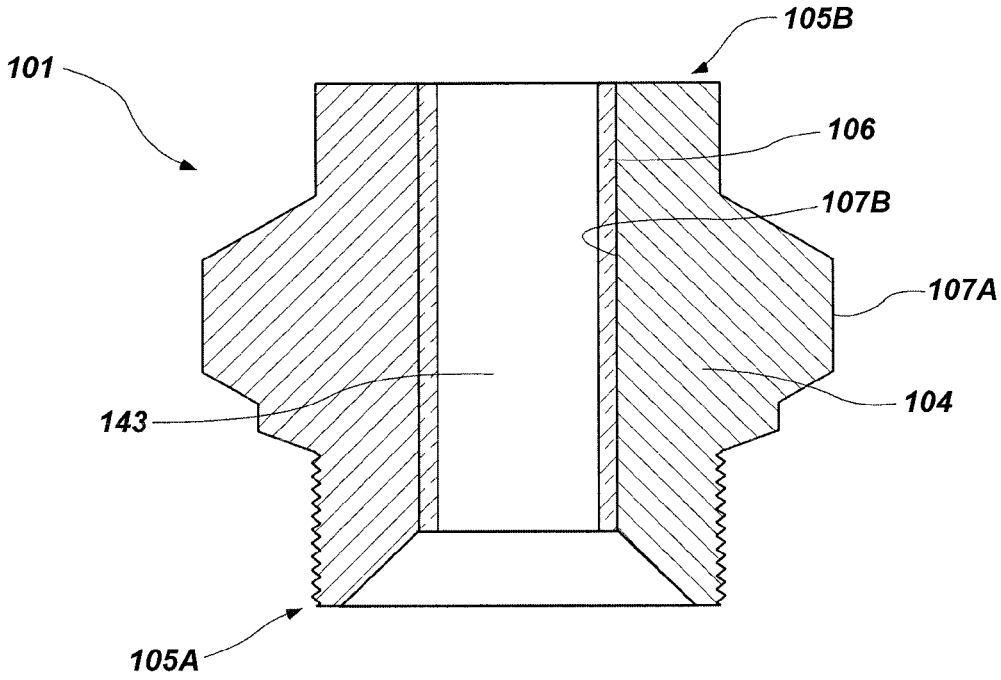
FIG. 3 is an enlarged longitudinal cross-sectional view of the erosion-resistant extension shown in FIGS. 1 and 2.

FIG. 3 is an enlarged longitudinal, cross-sectional view of the erosion-resistant extension 101 of the drill bit 100. As previously mentioned, an erosion-resistant material 106 lines at least a portion of the generally tubular body 104 (e.g., at least a portion of the inner surface 107B). As used herein, the term "erosion-resistant material" means and includes any material lining another body, wherein the material exhibits a greater resistance to erosion by drilling fluid relative to a material of the another body. "Erosion resistance," as used herein, refers to a material's ability to resist wear when a drilling fluid (which comprises a liquid and, optionally but conventionally, solid particulate matter suspended in the liquid) impinges on a surface of the material.

A material's erosion resistance may be measured using various techniques known in the art, such as, for example, as defined in ASTM (American Society for Testing and Materials) G-73-04, which is entitled *Standard Practice for Liquid Impingement Erosion Testing*. In some embodiments, the erosion-resistant material 106 may exhibit an erosion resistance that is about 50% or more greater than an erosion resistance exhibited by the material of the generally tubular body 104. In further embodiments, the erosion-resistant material 106 may exhibit an erosion resistance that is about 100% or more greater than an erosion resistance exhibited by the material of the generally tubular body 104.

As a non-limiting example, the generally tubular body 104 may comprise a low-alloy steel (e.g., carbon steel 1020, low-alloy steel 8620, or any steel alloy having a carbon content less than about 0.30 wt. %). Attaching the generally tubular body 104 to the bit body 102 and the shank 103 (FIG. 2) (e.g. welding) may require exposing the generally tubular body 104 to high temperatures. Accordingly, any benefit obtained using a more expensive, heat-treated steel for the generally tubular body 104 may be lost subsequent to attachment to the bit body 102 and the shank 103 due to the high temperature of the attachment processes. Because the low-alloy steel is relatively soft, it may be relatively susceptible to fluid erosion. In other words, the low-alloy steel may exhibit a relatively low erosion resistance. Lining the generally tubular body 104 with an erosion-resistant material 106, therefore, protects the fluid passageway 143 of the generally tubular body 104 from fluid erosion.

In some embodiments, the erosion-resistant material 106 may comprise a particle-matrix composite material including particles of hard material dispersed throughout a matrix material. By way of example and not limitation, the hard particles may comprise a material selected from metal, diamond, boron carbide, boron nitride, silicon nitride, aluminum nitride, and carbides or borides of the group consisting of W, Ti, Mo, Nb, V, Hf, Zr, Si, Ta, and Cr. The matrix material may comprise a metal. For example, the metal may be selected from the group consisting of iron-based alloys, nickel-based alloys, cobalt-based alloys, titanium-based alloys, aluminum-based alloys, iron and nickel-based alloys, iron and cobalt-based alloys, and nickel and cobalt-based alloys. In additional embodiments, the matrix material may comprise a polymer material such as those described in U.S. Pat. No. 5,508,334, which issued Apr. 16, 1996 to Chen, and U.S. patent application Ser. No. 12/398,066, which was filed Mar. 4, 2009 by Eason et al., the disclosure of each of which is incorporated herein in its entirety by this reference. By way of example and not limitation, the polymer material may comprise at least one of styrene-butadiene-styrene, styrene-ethylene-butylene-styrene, styrene-divinylbenzene, styrene-isoprene-styrene, and styrene-ethylene-styrene.

The erosion-resistant material 106 may also comprise a brazed carbide (e.g., tungsten carbide) cladding, such as those commercially available under the trademark CONFORMA CLAD® by Conforma Clad, Inc. of New Albany, Ind. In yet further embodiments, the erosion-resistant material 106 may be formed by treating at least a portion of the inner surface 107B of the generally tubular body 104. By way of example and not limitation, the erosion-resistant material 106 may comprise a carbide material, a boride material, or a nitride material formed by respectively carburizing, boronizing, or nitriding at least a portion of the inner surface 107B of the generally tubular body 104. Examples of such processes that may be used in embodiments of the present invention are disclosed in, for example, U.S. Pat. No. 3,922,038, which issued Nov. 25, 1975 to Scales, the disclosure of which is incorporated herein in its entirety by this reference. In still further embodiments, the erosion-resistant material 106 may comprise a polymer, such as, for example, at least one of a hard epoxy, an elastomer, and a plastic. The erosion-resistant material 106 may also comprise a multi-layer structure including at least two layers, wherein each layer comprises at least one of the erosion-resistant materials discussed above.

As a non-limiting example, in one embodiment, the generally tubular body 104 may comprise a low-alloy steel, and the erosion-resistant material 106 may comprise a particle-matrix composite material comprising tungsten carbide hard particles dispersed throughout a nickel-based metal alloy matrix material. Such an erosion-resistant material 106 comprising the particle-matrix composite material may exhibit an erosion resistance at least about 68%-97% greater than an erosion resistance exhibited by the low-alloy steel of the generally tubular body 104.

The erosion-resistant extension 101 as shown in FIG. 3 may be formed by, for example, depositing an erosion-resistant material 106 onto at least a portion of a surface of the fluid passageway 143 of the generally tubular body 104. In other words, in some embodiments, the erosion-resistant material 106 may comprise a deposit of erosion-resistant material 106. The erosion-resistant material 106 may be deposited onto at least a portion of a surface of the fluid passageway 143 of the extension 101 using methods as known in the art. For example, in some embodiments, a layer of the erosion-resistant material 106 may be applied onto the surface of the generally tubular body 104 within the fluid passageway 143 using, for example, any of various welding processes known in the art including metal-inert gas (MIG) welding processes, tungsten-inert gas (TIG) welding processes, and plasma arc welding (PAW) processes. In additional embodiments, a paste or slurry comprising the material components of the erosion-resistant material 106 and one or more solvents may be disposed over at least a portion of the surface of the generally tubular body 104 within the fluid passageway 143. The solvent may then be evaporated from the paste or slurry, and, if necessary or desirable, a sintering process may be used to form the erosion-resistant material 106 from the material components thereof originally presented in the paste or slurry. As another example, thermal spray processes may be used to deposit the erosion-resistant material 106 onto at least a portion of the surface of the generally tubular body 104 within the fluid passageway 143. For example, a high-velocity oxy-fuel (HVOF) process may be used to deposit the erosion-resistant material 106 onto the generally tubular body 104 within the fluid passageway 143.

By using an erosion-resistant extension 101, as described herein, in a drill bit 100, the rate of erosion of the erosion-resistant extension 101 caused by the flow of drilling fluid through the fluid passageway 143 may be substantially lower than the rate at which previously known extensions eroded due to the flow of drilling fluid therethrough and consequently may increase the working life of the drill bit 100.

Figure 4:
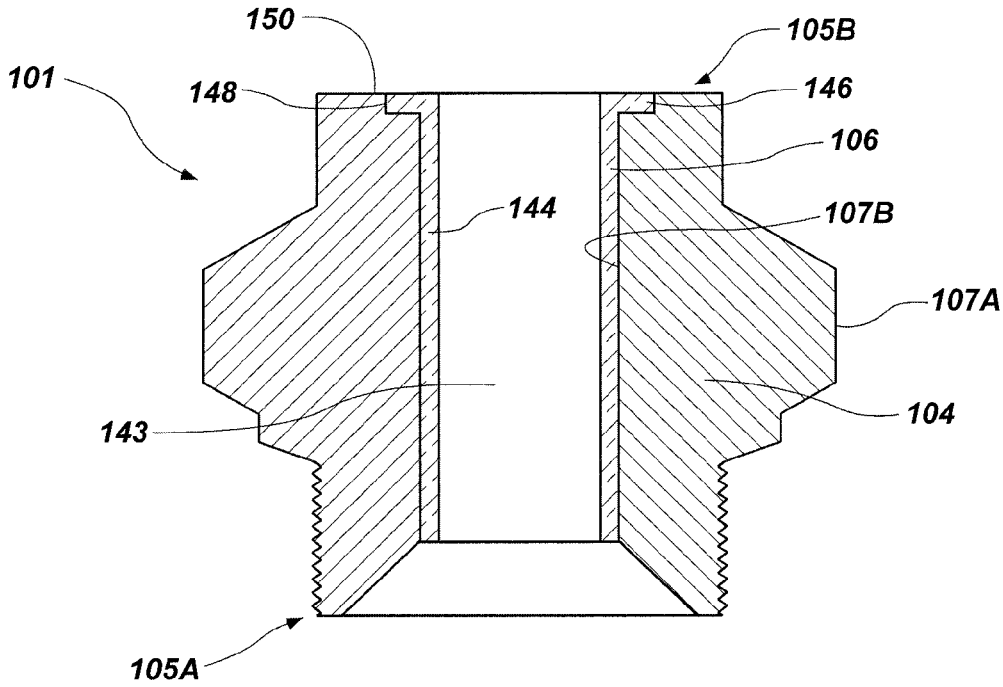
FIG. 4 is an enlarged longitudinal cross-sectional view like that of FIG. 3 illustrating another embodiment of an erosion-resistant extension.

Another embodiment of an erosion-resistant extension 101 of the present invention for use in an earth-boring tool 100 (FIG. 1) is shown in an enlarged longitudinal cross-sectional view in FIG. 4. As shown in FIG. 4, an insert sleeve 144 comprising a liner of the erosion-resistant material 106 may be disposed (e.g., inserted) at least partially within (e.g., entirely within) the fluid passageway 143 of the generally tubular body 104. In some embodiments, one or more surfaces of the sleeve 144 may be configured to abut against one or more complementary surfaces of the generally tubular body 104. For example, complementary positioning features may be provided on the sleeve 144 and the generally tubular body 104 to facilitate proper relative positioning therebetween during assembly. In some embodiments, as shown in FIG. 4, the sleeve 144 may comprise a male connection feature, such as a protrusion 146 shaped as a radially projecting flange extending circumferentially at least partially around a longitudinal axis of the sleeve 144. The generally tubular body 104 may comprise a female connection feature, such as an annular receptacle or recess 148 formed in an end surface 150 of the generally tubular body 104 and extending circumferentially around at least a portion of the fluid passageway 143 of the generally tubular body 104. The recess 148 may have a complementary size and shape complementary to that of the protrusion 146 and may be configured to receive the protrusion 146 therein. In some embodiments, at least a portion of the sleeve 144 and the fluid passageway 143 of the generally tubular body 104 may have a generally cylindrical or tubal shape. In some embodiments, the sleeve 144, including the protrusion 146, may be flush with the end surface 150 (FIG. 4) of the generally tubular body 104 such that the shank 103 (FIG. 1) may be coupled to the generally tubular body 104 without alterations to the shape of the shank 103. In the embodiment of FIG. 4, when the shank 103 is coupled to the generally tubular body 104, mechanical interference between the sleeve 144 and each of the shank 103 and the generally tubular body 104 may be used to retain the sleeve 144 in position within the drill bit 100.

While the protrusion 146 is illustrated in FIG. 4 as having an annular and generally planar geometry, the protrusion 146 and the recess 148 may have other complementary geometric configurations for retaining the sleeve 144 in the generally tubular body 104. For example, any protruding shape capable of mechanically supporting or suspending the sleeve 144 prior to assembly with shank 103 may be utilized. As non-limiting examples, the protrusion 146 may have at least one beveled or tapered surface, or the protrusion 146 may consist of at least two supporting members extending from opposing sides of the sleeve 144. The recess 148 may similarly be formed as any shape complementary to the protrusion 146.

In some embodiments, the sleeve 144 may be at least partially secured within the generally tubular body 104 using, for example, a bonding material, such as an adhesive, or by soldering, brazing, or welding the sleeve 144 to the generally tubular body 104. When the sleeve 144 is secured by a bonding material within the generally tubular body 104, the bond between the sleeve 144 and the generally tubular body 104 must be able to withstand the operating conditions typically encountered during drilling processes (which may include high pressure, pulsating pressure, and temperature changes).

In other embodiments, the sleeve 144 may simply be retained within the generally tubular body 104 by mechanical support. In other words, there may be no bonding material securing the sleeve 144 to the generally tubular body 104, and the sleeve 144 may simply be disposed within the extension 101 such that the protrusion 146 lies in the recess 148, thereby mechanically supporting the sleeve 144. By not using a bonding material to attach the sleeve 144 to the generally tubular body 104, the sleeve 144 may be easily removed and repaired or replaced as the sleeve 144 becomes eroded or damaged from the drilling fluid during drilling without alteration to the generally tubular body 104. In other embodiments, sleeve 144 and inner surface 107B may be cooperatively sized so that sleeve 144 may be pressed into fluid passageway 143 of tubular body 104 and retained therein by an interference fit.

The sleeve 144 may be formed using, for example, a sintering process in which a particulate green body is sintered to form the sleeve 144. Such a particulate green body may be formed using known green body forming techniques including, for example, powder pressing techniques, powder injection molding techniques, and casting techniques (e.g., slurry casting techniques and tape casting techniques). For example, in an injection molding process, a powder mixture comprising hard particles and particles of a matrix material (and, optionally, organic binders, lubricants, compaction aids, etc.) may be injected into a mold cavity having a shape corresponding to a desirable shape for a sleeve 144 to form a green body. The green body then may be removed from the mold and sintered to a desired final density in a furnace to form the sleeve 144.

According to embodiments of the invention, forming a recess 148 in the generally tubular body 104 may be accomplished by machining the recess 148 in the generally tubular body 104. For example, if the generally tubular body 104 is manufactured from a steel billet, the recess 148 may be easily machined to size and configured for receiving a sleeve. As another example, if the generally tubular body 104 is manufactured using a pressing and sintering process, the recess 148 may be machined into the "brown" or "green" body prior to final sintering, and after final sintering, the sleeve may be inserted into the recess 148, as mentioned above.

Embodiments of erosion-resistant extensions 101 of the present invention may be utilized with new drill bits, or they may be used to repair used drill bits for further use in the field. Use of an erosion-resistant extension 101 with a drill bit as described herein may enable replacement of the erosion-resistant material 106 in a worn generally tubular body 104 and may decrease erosion in generally tubular bodies 104 of extensions 101. Utilizing embodiments of erosion-resistant extensions 101 of the present invention, the erosion-resistant material may be replaced as necessary or desirable, as in the case wherein the erosion-resistant material 106 has eroded away to expose at least a portion of the generally tubular body 104. In other words, a shank 103 (FIG. 1) may be separated from the generally tubular body 104, a worn (e.g., eroded) insert sleeve 144 may be removed from the generally tubular body 104, a new insert sleeve 144 may be inserted into the generally tubular body 104, and the shank 103 (or a new shank 103) may be reattached to the generally tubular body 104.

The advantages of the invention mentioned herein for pressed and sintered bit bodies may apply similarly to infiltrated bit bodies (which are bit bodies comprising a particle-matrix composite material formed using an infiltration process) and to steel bit bodies (which are formed by machining a steel forging or casting).

Embodiments of the present invention may include, without limitation, core bits, bi-center bits, eccentric bits, so-called "reamer wings" as well as drilling and other downhole tools that may employ, or benefit from employing, an erosion-resistant extension as described hereinabove. Therefore, as used herein, the terms "earth-boring drill bit" and "drill bit" encompass all such structures.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed, including legal equivalents. In addition, features from one embodiment may be combined with features of another embodiment while still being encompassed within the scope of the invention as contemplated by the inventors.

What is claimed is:

1. An erosion-resistant extension for an earth-boring rotary drill bit, the erosion-resistant extension comprising:

a generally tubular body having a shape defining a fluid passageway extending through the generally tubular body, the generally tubular body comprising:

an outer surface;

an inner surface having a recess;

a first end configured for attachment to a bit body of an earth-boring rotary drill bit; and an opposite, second end configured for attachment to a shank; and a generally tubular sleeve at least partially disposed within the fluid passageway, the generally tubular sleeve comprising:

an erosion-resistant material lining the generally tubular body within the fluid passageway, the erosion-resistant material exhibiting an erosion resistance greater than an erosion resistance exhibited by a material of the generally tubular body; and at least one protrusion extending circumferentially at least partially around a longitudinal axis of the generally tubular sleeve on an exterior surface of the generally tubular sleeve, the recess being configured to receive the at least one protrusion therein when the generally tubular sleeve is at last partially disposed within the fluid passageway, wherein the at least one protrusion has a planar surface transverse to the longitudinal axis of the generally tubular sleeve, the planar surface being flush with an end surface of the second end of the generally tubular body.

2. The erosion-resistant extension of claim 1, wherein the erosion resistance exhibited by the erosion-resistant material is at least about 50% greater than the erosion resistance exhibited by the material of the generally tubular body.

3. The erosion-resistant extension of claim 1, wherein the material of the generally tubular body comprises a steel alloy, and the erosion-resistant material comprises a particle-matrix composite material.

4. The erosion-resistant extension of claim 1, wherein the erosion-resistant material comprises at least one of a particle-matrix composite material and a polymer material.

5. The erosion-resistant extension of claim 4, wherein the erosion-resistant material comprises a particle-matrix composite material comprising a plurality of hard particles dispersed throughout a matrix material, the hard particles comprising at least one material selected from diamond, boron carbide, boron nitride, silicon nitride, aluminum nitride, and carbides or borides of the group consisting of W, Ti, Mo, Nb, V, Hf, Zr, Si, Ta, and Cr, the matrix material selected from the group consisting of iron-based alloys, nickel-based alloys, cobalt-based alloys, titanium-based alloys, aluminum-based alloys, iron and nickel-based alloys, iron and cobalt-based alloys, and nickel and cobalt-based alloys.

6. The erosion-resistant extension of claim 1, wherein the erosion-resistant material comprises a plurality of layers.

7. The erosion-resistant extension of claim 1, wherein the erosion-resistant material comprises a deposit of the erosion-resistant material.

8. The erosion-resistant extension of claim 1, wherein the erosion-resistant material comprises a particle-matrix composite material comprising a plurality of hard particles dispersed throughout a titanium-based alloy matrix material.

9. An earth-boring rotary drill bit comprising:

a bit body having a face;

at least one cutting element on the face of the bit body;

an extension comprising:

a generally tubular body having a shape defining a fluid passageway extending through the generally tubular body between a first end of the generally tubular body and an opposite, second end of the generally tubular body, the first end of the generally tubular body coupled to the bit body, wherein the first end of the generally tubular body is threadedly engaged to a collar bonded to at least one surface in a cavity of the bit body; and an erosion-resistant material lining at least a portion of the generally tubular body within the fluid passageway, the erosion-resistant material exhibiting an erosion resistance greater than an erosion resistance exhibited by a material of the generally tubular body; and a shank coupled to the opposite, second end of the generally tubular body of the extension, the shank configured for attachment to a drill string.

10. The earth-boring rotary drill bit of claim 9, wherein the bit body predominantly comprises a particle-matrix composite material comprising a plurality of hard particles dispersed throughout a matrix material.

11. The earth-boring rotary drill bit of claim 10, wherein the erosion-resistant material comprises another particle-matrix composite material, and the material of the generally tubular body comprises a metal alloy.

12. The earth-boring rotary drill bit of claim 9, wherein the erosion-resistant material comprises one of a deposit of the erosion-resistant material and an insert comprising the erosion-resistant material.

13. A method of forming an earth-boring rotary drill bit, comprising:

selecting an erosion-resistant material to exhibit an erosion resistance greater than an erosion resistance exhibited by a material of a generally tubular body;

lining at least a portion of a wall of the generally tubular body within a fluid passageway extending through the generally tubular body with the selected erosion-resistant material;

coupling a first end of the generally tubular body to an earth-boring rotary drill bit, further comprising threadedly engaging the first end of the generally tubular body to a collar, the collar being configured to be secured to the rotary drill bit; and coupling a shank to an opposite, second end of the generally tubular body.

14. The method of claim 13, wherein lining the at least a portion of the wall of the generally tubular body within the fluid passageway comprises treating the at least a portion of the wall of the generally tubular body to form the selected erosion-resistant material.

15. The method of claim 13, wherein selecting the erosion-resistant material further comprises selecting the erosion-resistant material to exhibit an erosion resistance at least about 50% greater than the erosion resistance exhibited by the material of the generally tubular body.

16. The method of claim 13, wherein lining the at least a portion of the wall of the generally tubular body with the selected erosion-resistant material comprises:

forming a sleeve comprising the selected erosion-resistant material; and disposing the sleeve at least partially within the fluid passageway extending through the generally tubular body.

17. The method of claim 16, further comprising:

forming at least one protrusion extending from an outer surface of the sleeve, the at least one protrusion extending circumferentially at least partially around a longitudinal axis of the sleeve;

forming at least one recess in a surface of the generally tubular body; and inserting the at least one protrusion of the sleeve at least partially into the at least one recess in the surface of the generally tubular body.

18. The method of claim 13, wherein lining the at least a portion of a wall of the generally tubular body within the fluid passageway comprises depositing the erosion-resistant material on the wall of the generally tubular body within the fluid passageway.

19. The method of claim 18, wherein depositing the erosion-resistant material on the wall of the generally tubular body within the fluid passageway comprises disposing a slurry including a portion of the erosion-resistant material and at least one solvent over at least a portion of the wall of the generally tubular body within the fluid passageway and evaporating the solvent from the slurry.

20. The method of claim 19, further comprising sintering the remaining erosion-resistant material.

21. The method of claim 18, wherein depositing the erosion-resistant material on the wall of the generally tubular body within the fluid passageway comprises applying a thermal spray including the erosion-resistant material to at least a portion of the wall of the generally tubular body.

22. The method of claim 14, wherein treating the at least a portion of the wall of the generally tubular body to form the selected erosion-resistant material comprises one of carburizing, boronizing and nitriding the at least a portion of the wall.

* * * * *